United States Patent [19]

Benaksas

[11] Patent Number: 4,724,966

[45] Date of Patent: Feb. 16, 1988

[54] DISPLAY FOR EYEGLASSES

[76] Inventor: Maurice Benaksas, 166 Trenton Ave., Town of Mount-Royal, Quebec, Canada, H3P 1Z4

[21] Appl. No.: 933,124

[22] Filed: Nov. 21, 1986

[51] Int. Cl.[4] ..... A47F 7/02

[52] U.S. Cl. ..... 211/13; 211/87; 248/DIG. 2

[58] Field of Search ..... 211/13, 87, 163; 248/DIG. 2

[56] References Cited

U.S. PATENT DOCUMENTS

| | | | |
|---|---|---|---|
| 2,467,251 | 4/1949 | Bowman | 248/DIG. 2 X |
| 2,468,437 | 4/1949 | Foley | 248/DIG. 2 X |
| 2,656,917 | 10/1953 | Hollis | 248/DIG. 2 X |
| 2,958,495 | 11/1960 | Foster | 248/DIG. 2 X |
| 4,128,224 | 12/1978 | Guichard | 248/DIG. 2 X |
| 4,558,788 | 12/1985 | Grothaus | 211/13 |

FOREIGN PATENT DOCUMENTS

| | | | |
|---|---|---|---|
| 1258283 | 3/1961 | France | 248/DIG. 2 |
| 1441581 | 7/1976 | United Kingdom | 248/DIG. 2 |

*Primary Examiner*—Robert W. Gibson, Jr.
*Attorney, Agent, or Firm*—Swabey, Mitchell, Houle, Marcoux & Sher

[57] ABSTRACT

An elongated rod, having a longitudinal direction, has a plurality of frameholders spacedly mounted thereon. Each frameholder includes a butterfly-like arrangement having a first wing and a second wing spaced from the first wing in a direction perpendicular to the longitudinal direction of the rod. The wings flare outwardly from the longitudinal axis and in the longitudinal direction of the rod.

3 Claims, 5 Drawing Figures

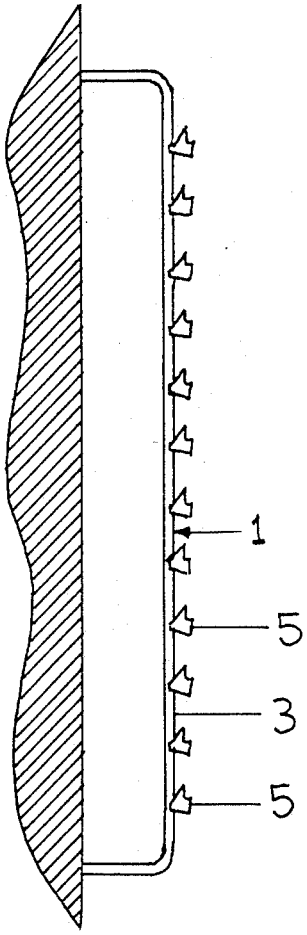
FIG. 1
FIG. 3
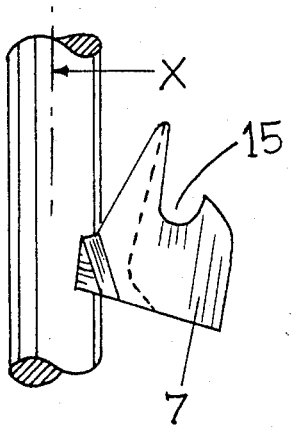
FIG. 4
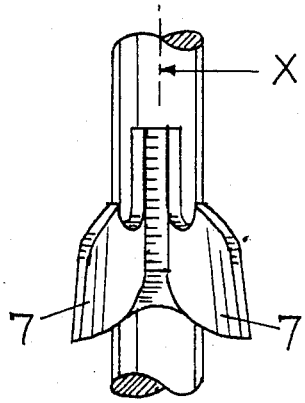
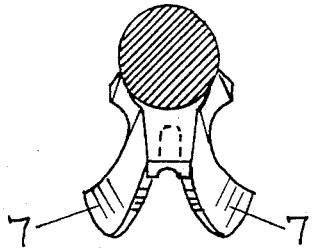
FIG. 5

DISPLAY FOR EYEGLASSES

BACKGROUND OF INVENTION

1. Field of the Invention

The invention relates to a display arrangement for optical frames. More specifically, the invention relates to such an arrangement comprising an elongated rod and a plurality of butterfly-like arrangements spacedly mounted on said rod along the length thereof.

2. Description of Prior Art

There are many different types of display arrangements for optical frames in the prior art. However, to the knowledge of the Applicant, there are none which employ butterfly-like arrangements for the purpose of engaging the optical frames and maintaining them mounted on the elongated rod.

SUMMARY OF INVENTION

It is therefore an object of the invention to provide a display arrangement for optical frames including a plurality of butterfly-like arrangements spacedly mounted on an elongated rod along the length thereof.

In accordance with the invention, there is provided a display arrangement for optical frames, each optical frame including two nose-engaging members separated by a bridge. The display arrangement includes an elongated rod having a longitudinal axis in the longitudinal direction thereof. A plurality of frameholders are spacedly mounted on the rod. Each frameholder includes a butterfly-like arrangement having a first wing, extending generally in the longitudinal direction of the rod, and a second wing, spaced from the first wing and in alignment with the first wing in a direction perpendicular to the longitudinal axis of the rod and extending generally in the longitudinal direction of the rod. Each frame is mountable on a respective one of the butterfly arrangements such that a respective one of the wings engages a respective one of the nose-engaging members.

BRIEF DESCRIPTION OF DRAWINGS

The invention will be better understood by an examination of the following description, together with the accompanying, in which:

FIG. 1 illustrates the display arrangement in accordance with the invention;

FIG. 3 is a side view of the butterfly-like arrangement;

FIG. 4 is a front view of the butterfly-like arrangement; and

FIG. 5 is a top view of the butterfly-like arrangement.

DESCRIPTION OF PREFERRED EMBODIMENTS

Figure 2:
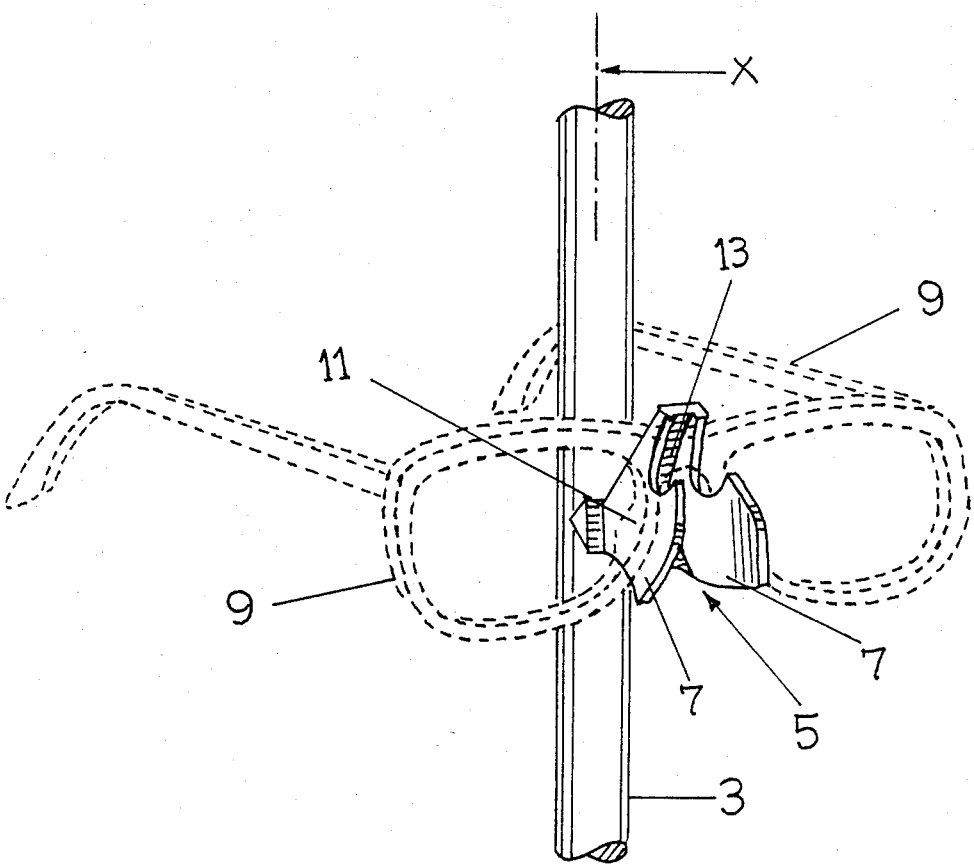
FIG. 2 is an expanded view of one of the butterfly-like arrangements with a pair of optical frames mounted thereon.

Referring to the drawings, the display arrangement, illustrated generally at 1 in FIG. 1, comprises an elongated rod 3 having a plurality of butterfly-like arrangements 5 spacedly mounted along the length of the rod. Preferably, there is equal spacing between each adjacent butterfly-like arrangement.

Although in FIG. 1 the rod is wall-mounted, it will of course be appreciated that it is contemplated also to use the invention with a rod mounted in a stand or fixed in some other way as is well known in the art. As can be seen, the butterfly-like arrangements are mounted in alignment with each other along a like surface of the elongated rod.

Turning now to FIGS. 2 to 5, each butterfly-like arrangement comprises two wings 7. As seen in FIGS. 3 and 4, the wings extend generally in the longitudinal direction X of the elongated rod 3. As best seen in FIG. 4, the wings flare outwardly in the downward direction. Optical frames 9 are mounted on the butterfly arrangements as shown in FIG. 2.

The optical frames include nose-engaging members 11 (only one of which is shown in FIG. 2), and a bridge 13 connecting the nose-engaging members. A notch 15 is included in the upper portion of each wing as seen in FIG. 3.

As seen in FIG. 2, the bridge 13 of the optical frame fits into the notch 15 of the butterfly-like arrangement. The nose-engaging members 11 are supported by a respective one of the wings 7.

Accordingly, the optical frames are solidly held on the display arrangement and, at the same time, are easily removable therefrom.

Although a particular embodiment has been described, this was for the purpose of illustrating, but not limiting, the invention. Various modifications, which will come readily to the mind of one skilled in the art, are within the scope of the invention as defined in the appended claims.

I claim:

1. A display arrangement for optical frames, each optical frame including two nose-engaging members separated by a bridge, said display arrangement comprising:

an elongated vertical rod having a longitudinal axis in the longitudinal direction thereof;

a plurality of frameholders spacedly mounted on said rod;

each said frameholder including;

a butterfly-like arrangement having a first wing extending generally in the longitudinal direction of said rod, and a second wing, spaced from said first wing and in alignment with said first wing in a direction perpendicular to the longitudinal axis of said rod, and extending generally in the longitudinal direction of said rod;

each said frame being mountable on a respective one of said butterfly arrangements such that a respective one of said wings engages a respective one of said nose-engaging members;

said wings flaring outwardly from said longitudinal direction in the downward direction of said rod and including a notch in the upper part of each said wing;

the bridge of an optical frame resting on said notches when mounted on the display arrangement.

2. An arrangement as defined in claim 1 wherein said butterfly arrangements are each equally spaced from adjacent ones thereof.

3. An arrangement as defined in claim 2 wherein said butterfly arrangements are in alignment in the longitudinal direction of said display arrangement and on a like surface of said display arrangement.

* * * * *